US006116421A

United States Patent [19]

Collins

[11] Patent Number: 6,116,421

[45] Date of Patent: Sep. 12, 2000

[54] CARRIER FOR A PACKAGE OF BOX-LIKE ITEMS

[75] Inventor: Shane M. Collins, Eltham, Australia

[73] Assignee: Eastman Kodak Company, Rochester, N.Y.

[21] Appl. No.: 09/214,579

[22] PCT Filed: Jul. 28, 1997

[86] PCT No.: PCT/AU97/00472

§ 371 Date: Jan. 7, 1999

§ 102(e) Date: Jan. 7, 1999

[87] PCT Pub. No.: WO98/04475

PCT Pub. Date: Feb. 5, 1998

[30] Foreign Application Priority Data

Jul. 30, 1996 [AU] Australia ..... PN1302

[51] Int. Cl.[7] ..... B65D 85/671

[52] U.S. Cl. ..... 206/455; 206/497; 229/117.14

[58] Field of Search ..... 206/83.5, 175, 206/180, 193, 194, 432, 455, 497, 526; 229/117.12, 117.14, 117.15; 294/141, 142, 158, 165, 137

[56] References Cited

U.S. PATENT DOCUMENTS

| | | | |
|---|---|---|---|
| 1,522,311 | 1/1925 | MacLellan | 229/117.14 |
| 2,160,551 | 5/1939 | Lupton | 206/194 |
| 2,217,028 | 10/1940 | Powell | 206/193 |
| 2,393,114 | 1/1946 | Lyons, Jr. | 206/194 |
| 2,675,264 | 4/1954 | Vander Lugt, Jr. | 229/117.14 |
| 2,685,402 | 8/1954 | Caster | 229/117.14 |
| 4,131,227 | 12/1978 | Patton et al. | 229/117.14 |
| 4,318,505 | 3/1982 | Cordell, Jr. | 229/117.14 |
| 4,319,682 | 3/1982 | Wright et al. | 206/180 |
| 4,397,393 | 8/1983 | Pergande et al. | 229/117.14 |
| 4,838,430 | 6/1989 | Beeman et al. . | |
| 5,437,363 | 8/1995 | Gungner . | |
| 5,667,071 | 9/1997 | Nagagoshi et al. | 206/455 |

FOREIGN PATENT DOCUMENTS

| | | |
|---|---|---|
| 121649 | 6/1946 | Australia . |
| 262744 | 8/1964 | Australia . |
| 65/64044 | 3/1967 | Australia . |
| 95/16208 | 11/1995 | Australia . |
| 666635 | 2/1996 | Australia . |
| 676631 | 2/1996 | Australia . |
| 1229824 | 12/1987 | Canada . |
| WO 96/35625 | 11/1996 | WIPO . |

*Primary Examiner*—Jim Foster
*Attorney, Agent, or Firm*—Susan L. Parulski

[57] ABSTRACT

A carrier 1 for a package of box-like items 6. An upper portion includes a carry handle and a lower portion 4 forming a surround around the box-like items which releasably engages the package.

13 Claims, 3 Drawing Sheets

CARRIER FOR A PACKAGE OF BOX-LIKE ITEMS

FIELD OF THE INVENTION

This invention relates to a carrier for a package of box-like items. In an example application of the invention to be described herein, the carrier is for a package of boxes containing rolls of photographic film. However, the described example application is not to be understood as limiting on the invention because it is applicable to packages of any box-like items. The invention also relates to a carrier and a package of box-like items in combination.

BACKGROUND OF THE INVENTION

Lay or casual photography is very popular and relatively cheap, pocket size, compact and fully automatic cameras are readily available to tourists and others to facilitate such photography. In this environment, individuals are tending to buy increased stocks of film for such cameras in a single purchase, for example, up to about 20 boxes of film may be purchased at the one time. To meet this demand, photographic film suppliers are now supplying their boxes of film in packages containing a reasonably large number, say 8, 12 or 20, of the boxes.

SUMMARY OF THE INVENTION

The present invention seeks to provide a convenient choice to customers for carriage of such a package of boxes or of box-like items.

According to the invention there is provided a carrier for a package of box-like items including:

an upper portion forming a carry handle; and a lower portion for fitting around the package of box-like items, wherein the lower portion includes means for releasably engaging the package of box-like items.

Preferably the lower portion of the carrier is for fitting around a top section of the package.

Terms such as "upper", "lower", "top section" or the like in this specification are to be construed with reference to the carrier in a normal use orientation. However, it is to be understood that the carrier can have other orientations, and thus, the terms in question are not to be applied to limit the scope of this disclosure to any particular orientation for the invention.

Preferably, the means for releasably engaging the package of box-like items includes tabs for insertion between facing surfaces of the box-like items in the package.

In a particularly preferred embodiment of the invention, the carrier is formed from a relatively stiffly flexible material, such as a cardboard blank, which is folded to effectively simultaneously both form the carrier and assemble it with the package of box-like items. During this folding operation, the tabs are inserted between facing surfaces of the package of box-like items and the lower portion is fitted around the package to form a surround. Preferably, a tab extends from the lower end of each of two opposite sides of the surround, and the surround is formed by inserting at least one tab of another form, that is a connection tab, on the blank into a complimentary slit in the blank. Preferably, the lower surround portion of the carrier is a firm fit around the package such that the tab and slit connection for the surround will be more tightly held together by the pressure between the package and the surround.

Preferably, the lower portion of the carrier includes a depending section for obscuring a surface, or part thereof, of the package of box-like items. This feature ensures that printed information such as, for example, a bar code or the like outer facing surface of the box-like items can be obscured. When purchasing a package combined with the carrier, this feature ensures there is no danger that a bar code relevant to only one of the box-like items will be scanned to give a price or other indication for the one item only and not the package.

The invention also includes a carrier as described above in combination with a package of box-like items. Preferably, the box-like items are surrounded by a shrink-wrap to form the package and the shrink wrap does not cover the package adjacent the facing surfaces of the box-like items between which the tabs are received. Thus, the shrink wrap does not have to be pierced to insert the tabs into the package.

The invention also includes a blank of cardboard or like material for folding to form the carrier.

An embodiment of the invention will now be described, by way of non-limiting example only, with reference to the accompanying drawings.

DETAILED DESCRIPTION OF THE INVENTION

Figure 1:
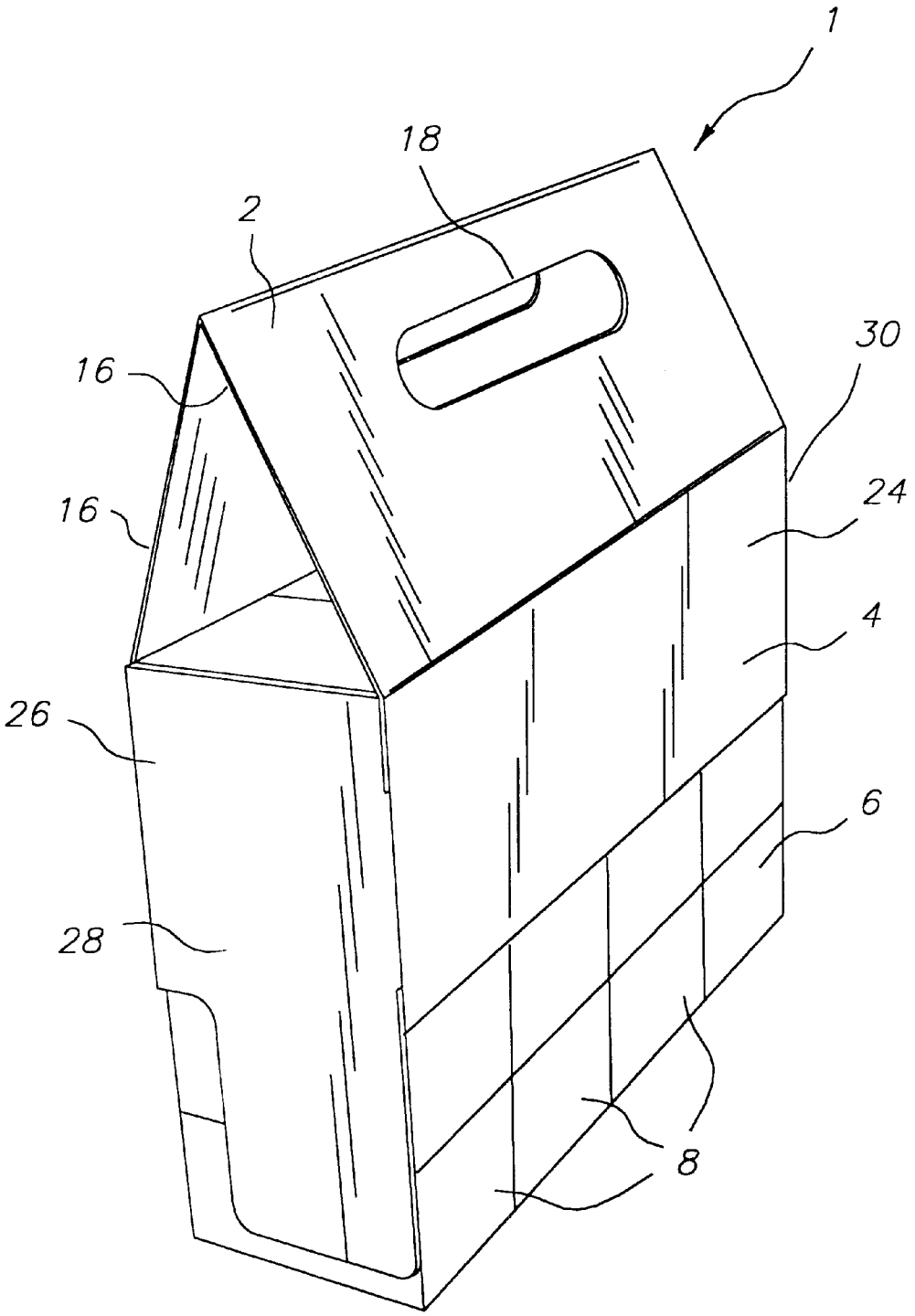
FIG. 1 shows a carrier according to an embodiment of the invention assembled with a package of box-like items.

A carrier 1 according to the invention as illustrated in FIG. 1 includes an upper portion 2 forming a carry handle and a lower portion 4 that fits around the top portion of a package of box-like items 6. The package of box-like items 6 preferably comprises rectangular section boxes 8 of rolls of photographic film. For example, the package may include twenty boxes 8 arranged in a stack that is five boxes long and four boxes high. Other arrangements of the box-like items are encompassed within the scope of the invention. The stack of boxes is preferably formed into a package by being wrapped with a shrink wrap material 10 such as cellorap film. Preferably, this shrink wrap material does not cover the opposite sides 12, 14 of the package 6 at areas adjacent the facing surfaces between two rows of boxes 8 where ready access to those facing surfaces is required. Such access is required for insertion of a tab, as will be described below.

Figure 2:
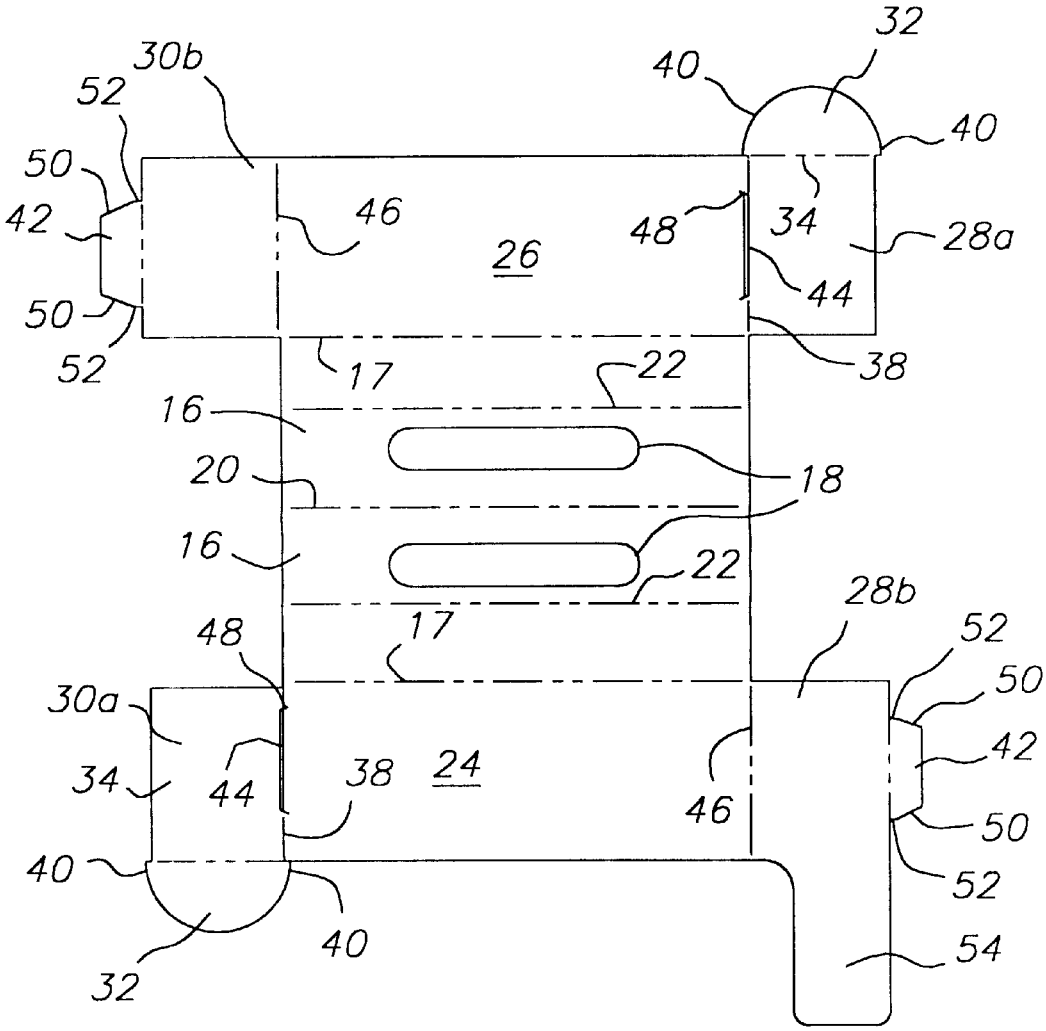
FIG. 2 shows a cardboard blank for forming the carrier of FIG. 1.

The carrier 1 may be formed by folding an appropriately shaped cardboard blank, a shape for which is illustrated in plan in FIG. 2. The upper portion of the carrier includes two panel sections 16 which include cut-outs 18, and which are folded about a central fold line 20 into a ridged roof-like structure for placement over the package 6. Panel sections 18 may also be folded along fold lines 22 to give some flexibility to the handle structure, for example to allow the cut-outs to move more closely together.

The lower portion of the carrier 1 includes front and rear panels 24, 26 which are an extension of panel sections 16 and formed by folding about fold lines 17, and opposite side walls 28, 30 which are for fitting around a top section of the package 6. In the particular example of the invention which is illustrated, the lower portion 4 of the carrier 1 (comprising panels 24, 26, and walls 28, 30) fits around the top two rows of boxes 8, however, the invention includes arrangements where the lower portion of the carrier fits around a single row or multiple rows of the box-like items, and the term "top section" of the package is to be understood in this light.

Figure 3:
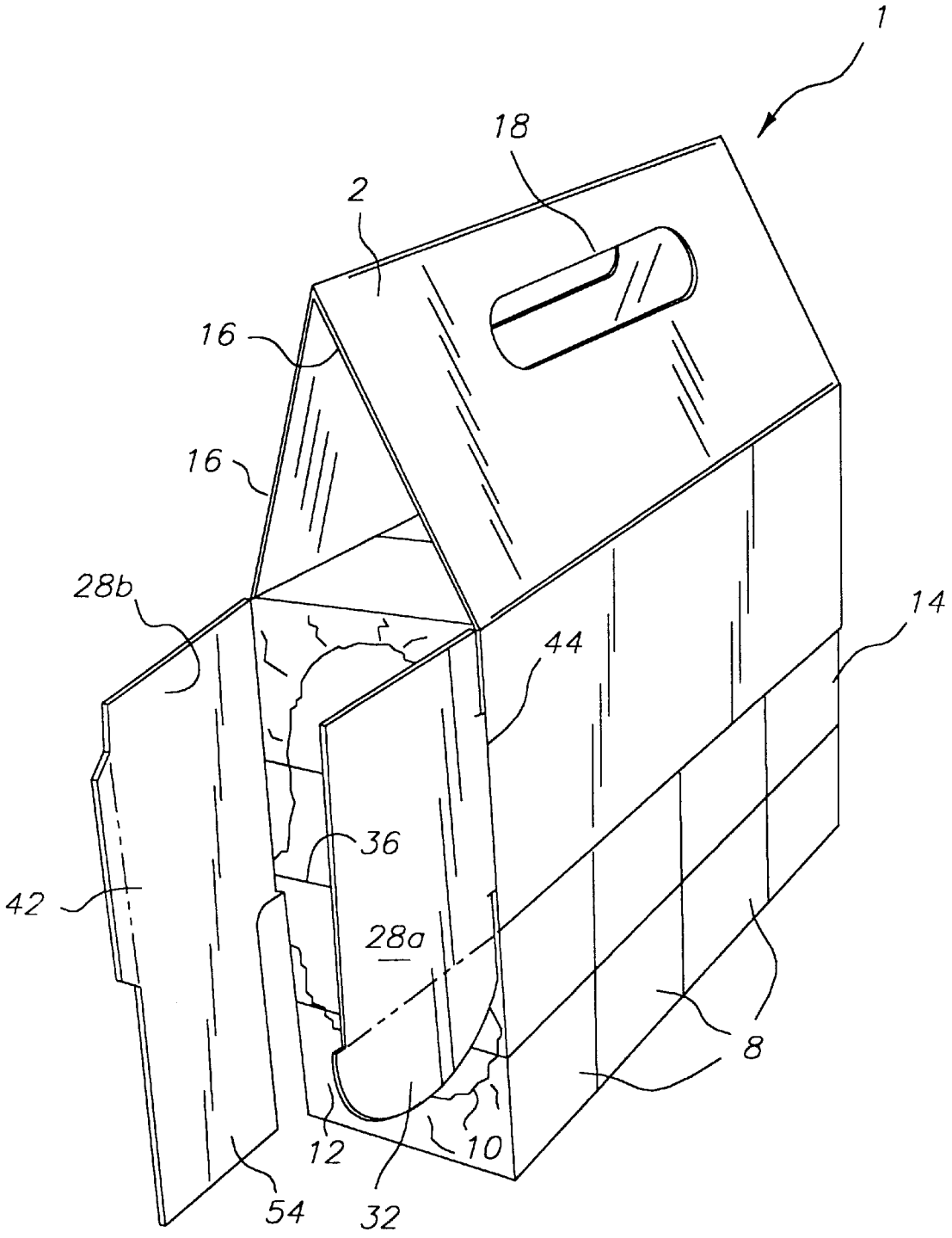
FIG. 3 shows the blank of FIG. 1 partially assembled about the package of box-like items.

As best seen in FIGS. 2 and 3, the opposite side walls 28, 30 comprise flap sections 28*a*, 28*b* and 30*a*, 30*b* respectively, with the sections 28*a* and 30*a* having tabs 32 depending from their lower edges and which are foldable about fold lines 34 to lie substantially normally to the plane of flap sections 28*a* and 30*a*. Tabs 32 provide means for releasably engaging the package 6 by insertion between the facing surfaces of two rows of the boxes 8, i.e., at the locations indicated by reference 36. The tabs 32 are curved in an approximately semicircular shape to facilitate their insertion between boxes 8 at the locations 36 as the flap sections 28*a* and 30*a* are folded about fold lines 38 to lie adjacent the opposite sides 12 and 14 of package 6. The tabs 32 may also extend or bulge slightly outwardly of the width of the flap sections 28*a* and 30*a*, as indicated at references 40, to improve their engagement with the package 6. That is, these portions 40 of the tabs 32 will extend slightly outwardly of the package 6 to contact the shrink wrap 10 and thus provide the improved engagement.

The flap sections 28*b*, 30*b* include connection tabs 42 for insertion in slits 44 (formed along fold lines 38). Flaps 28*b*, 30*b* are folded about fold lines 46 to lie over flap sections 28*a* and 30*a*, respectively, and connection tabs 42 are inserted into slits 44 to complete the assembly of the carrier 1 on the package 6. Slits 44 may include a short side cut at each end as shown by reference 48 to facilitate insertion of the tabs 42. Also the tabs 42 may include sloping sides 50 and a small undercut 52 where the sides 50 meet the edge of each respective flap section 28*b*, 30*b*. This structure provides for a relatively positive retention of the connection tabs 42 in slits 44.

One of the side wall flap sections, for example section 28*b*, may include a depending section 54 for obscuring at least a part or all of the surface of a side wall 12 (or 14) of the package 6 to hide any printed information, such as a bar code, on each box-like item 8 along that side wall.

It will be appreciated that the lower portion 4 of carrier 1 forms a surround for the package, which surround is formed by the fitting of panels 24, 26, and walls 28 (comprising flap sections 28*a* and 28*b*) and 30 (comprising flap sections 30*a* and 30*b*) around the package 6. The surround is completed by the tab 42 and slit 44 connections, which provide an example co-operative means for securing the lower portion 4 of the carrier 1 as a surround for the package 6. The surround is a firm fit around the package 6 and this enhances the securement between the tabs 42 and slits 44 in that there is some pressure between the facing surfaces of the package and the panel sections of lower portion 4 between which the tabs 42 are located.

The invention described herein is susceptible to variations, modifications and/or additions other than those specifically described and it is to be understood that the invention includes all such variations, modifications and/or additions which fall within the spirit and scope of the above description.

What is claimed is:

1. A carrier for a package of box-like items, such as boxes of photographic film, including an upper portion forming a carry handle, a lower portion for fitting around the package of box-like items, wherein the lower portion includes means for releasably engaging the package of box-like items, the carrier being formed from a relatively stiffly flexible sheet material, wherein the upper and lower portions are formed by panels of the material which are joined along fold lines, wherein the upper portion forming a carry handle comprises two facing panels joined along an upper fold line with each panel including an aperture, wherein the lower portion comprises at least four panels for surrounding the package of box-like items and includes cooperative means for securing the lower portion as a surround, and wherein two of the at least four panels each depend from one of the facing panels along a fold line and form side panels of the carrier.

2. A carrier as claimed in claim 1, wherein the means for releasably engaging the package of box-like items includes a tab for insertion between facing surfaces of the box-like items in the package.

3. A carrier as claimed in claim 2, wherein at least two tabs are provided for insertion between facing surfaces of the box-like items in the package, wherein the tabs are oppositely located on the carrier.

4. A carrier as claimed in claim 1, wherein said cooperative means includes a connection tab and a slit for receiving the tab upon fitting the lower portion around a package of box-like items to thereby form a surround.

5. A carrier as claimed in claim 1, wherein the means for releasably engaging the package of box-like items comprises two tabs, each depending, along a fold line, from a panel of the at least four panels comprising the lower portion, wherein the tabs are oppositely located on the carrier for insertion between facing surfaces of the box-like items in the package.

6. A carrier as claimed in claim 1, wherein there are six panels for forming the lower portion comprising said two side panels and four flap sections, wherein each flap section extends from a side of said side panels, wherein said side panels are for extending along opposite sides of a package and the four flap sections are for extending over opposite ends of the package, wherein one flap section overlaps another to form each end of the carrier.

7. A carrier as claimed in claim 6, wherein the means for releasably engaging the package of box-like items comprises two tabs, each depending from an opposite flap section along a fold line for insertion between facing surfaces of the box-like items in the package.

8. A carrier as claimed in claim 7, wherein a slit is formed along the fold line between each side panel and the flap section that includes a tab for insertion between facing surfaces of the box-like items, and wherein the other two flap sections include a connection tab for insertion in a corresponding said slit, to thereby form a surround on a package of box-like items.

9. A carrier as claimed in claim 1, wherein the lower portion includes a depending section for obscuring a surface or part thereof of the package of box-like items.

10. A carrier as claimed in claim 1 in combination with a package of box-like items, wherein the means for releasably engaging the package comprise two oppositely located tabs inserted between facing surfaces of the box-like items.

11. A combination as claimed in claim 10, wherein the box-like items are surrounded by a shrink wrap to form the package, and wherein the shrink wrap does not cover the package adjacent the facing surfaces of the box-like items between which the tabs are received.

12. The combination as claimed in claim 10, wherein the box-like items are boxes containing rolls of photographic film.

13. A blank of cardboard or other relatively stiffly flexible sheet material capable of being folded into a carrier, comprising: upper and lower portions formed by panels of the material which are joined along fold lines, the upper portion forming a carry handle comprises two facing panels joined along an upper fold line with each panel including an aperture, the lower portion comprising six panels for surrounding a package of box-like items and including cooperative means for securing the lower portion as a surround, wherein two of the at least four panels each depend from one of the facing panels along a fold line and are adapted to form side panels of the carrier, wherein the six panels form the lower portion comprising said two side panels and four flap sections, wherein each flap section extends from a side of said side panels, wherein said side panels are adapted to extend along opposite sides of a package and the four flap sections are adapted to extend over opposite ends of the package, wherein one flap section is adapted to overlap another to form each end of the carrier, wherein the means for releasably engaging the package of box-like items comprises two tabs, each depending from an opposite flap section along a fold line for insertion between facing surfaces of the box-like items in the package, wherein a slit is formed along the fold line between each side panel and the flap section that includes a tab for insertion between facing surfaces of the box-like items, and wherein the other two flap sections include a connection tab for insertion in a corresponding said slit, to thereby form a surround on a package of box-like items.

* * * * *